United States Patent [19]

Iguchi et al.

[11] 4,310,613

[45] Jan. 12, 1982

[54] LIQUID PROCESSING COMPOSITION FOR SILVER COMPLEX DIFFUSION TRANSFER PROCESS

[75] Inventors: Shigeru Iguchi; Kazuhiro Emoto, both of Nagaokakyo, Japan

[73] Assignee: Mitsubishi Paper Mills, Ltd., Tokyo, Japan

[21] Appl. No.: 149,700

[22] Filed: May 14, 1980

[30] Foreign Application Priority Data

May 29, 1979 [JP] Japan ..... 54/66503

[51] Int. Cl.[3] ..... G03C 5/54; G03C 5/38

[52] U.S. Cl. ..... 430/251; 430/428; 430/429; 430/455

[58] Field of Search ..... 430/204, 206, 233, 234, 430/244, 246, 248, 249, 250, 251, 486, 488, 929, 965, 428, 429, 455, 456, 458, 459

[56] References Cited

U.S. PATENT DOCUMENTS

| | | | |
|---|---|---|---|
| 2,288,586 | 6/1942 | Dersch | 430/607 |
| 3,173,786 | 3/1965 | Green | 430/218 |
| 3,411,904 | 11/1968 | Becker | 430/218 |
| 3,549,370 | 12/1970 | Sykes | 430/428 |

*Primary Examiner*—Mary F. Downey

*Attorney, Agent, or Firm*—Cushman, Darby & Cushman

[57] ABSTRACT

A liquid processing composition for silver complex diffusion transfer process which contains the specific quaternary ammonium salts as defined in the specification prevents formation of colored sludge for a long time without damaging characteristics of silver complex diffusion transfer development and improves color tone of silver images obtained.

12 Claims, No Drawings

LIQUID PROCESSING COMPOSITION FOR SILVER COMPLEX DIFFUSION TRANSFER PROCESS

BACKGROUND OF THE INVENTION

This invention concerns a liquid processing composition for silver complex diffusion transfer process.

The silver complex diffusion transfer process (referred to as "DTR process" hereinafter) is well known and is disclosed in U.S. Pat. No. 2,352,014 and other patents and literatures. That is, in the DTR process, a silver complex is transferred imagewise by diffusion from the silver halide emulsion layer to the image receiving layer, where it is converted into a silver image generally in the presence of physical development nuclei. For this purpose, the silver halide emulsion layer exposed imagewise is placed or brought into contact with the image receiving layer in the presence of a developing agent and a silver halide solvent to convert the undeveloped silver halides to a soluble silver complex. The silver halide in the exposed portion of the silver halide emulsion layer is reduced to silver which, therefore, can no longer be dissolved and diffused. On the other hand, the silver halide in the unexposed portions of the silver halide emulsion layer is converted into a soluble silver complex, which is transferred to the image receiving layer where a silver image is formed generally in the presence of physical development nuclei.

Action of the silver halide in the exposed portions and that of the silver halide in the unexposed portions reverse in the case of fogged silver halide emulsions for direct positive.

DTR process can be widely employed for reproduction of documents, production of lithographic printing plates, production of block copies for plate making and for instant photography and the like.

Especially, in reproduction of documents and production of block copies for plate making, a negative material bearing a silver halide emulsion layer and a positive material bearing an image receiving layer containing physical development nuclei are allowed to contact with each other generally in a DTR processing solution containing a silver complex forming agent to form a silver image in the image receiving layer of the positive material. This silver image must be pure black or bluish black and must have sufficiently high density. Furthermore, high contrast and sharpness are required. In addition, high transfer speed is desirable.

Proposals for obtaining black silver images have been made in British Pat. No. 561875, Belgian Pat. No. 502525, Japanese Patent Examined Publications (Kokoku) No. 15734/64, No. 17747/64, No. 3957/65, No. 45542/72 and No. 1327/73 and Japanese Patent Unexamined Publication (Kokai) No. 49436/73, etc. Moreover, Japanese Patent Unexamined Publications (Kokai) No. 49436/73 and No. 1223/74 and Japanese Patent Examined Publications (Kokoku) No. 8146/64 and No. 25142/76 disclose improvement of density of silver images and Japanese Patent Examined Publication (Kokoku) No. 11093/63, No. 27568/64, No. 43778/76, etc. disclose improvement of transfer speed.

These specifications also describe contrast or sharpness of silver images formed on a positive material. Further consideration must be given on discoloration of white portions of positive materials as disclosed in Japanese Patent Examined Publications (Kokoku) No. 7296/63 and No. 17070/69 and on separability of negative material and positive material as disclosed in Japanese Patent Examined Publications No. 18134/63 and No. 15587/65.

However, the techniques proposed before do not satisfy all requirements, but have adverse effect on at least one other requirement. Therefore, all of the requirements cannot be easily satisfied even by combination of the known techniques and there has been a continuing need for overcoming the problems.

During developing process of silver halide photographic light sensitive materials, there are formed colored sludges in the developing solution which not only stain the solution, but stick to the photographic light sensitive materials and processing devices. Therefore, the developing solution must be often renewed or filtered. The silver halide in the films or printing papers is dissolved and enters the developing solution where it is reduced with developers to colloidal silver which is colored. Thus, the colored sludges are formed. A part of them easily coagulate and settle, but most of them float in the solution in the form of flocculated blackish brown dirty mud. Most of the developing solutions contain substances such as sodium sulfite which dissolve silver halides and so they have the defect as mentioned above. This defect is conspicuous in such developing solutions as for silver complex diffusion transfer process which contain water-soluble silver complex forming agents such as thiosulfates, thiocyanates, ammonia, ethanolamine and the like. The formation of the colored sludges can be retarded by lowering the temperature of the developing solution, but in this case the development is also delayed and so this is neither practical nor satisfactory.

Hitherto, it has been known that several mercapto heterocyclic compounds such as 1-phenyl-5-mercaptotetrazole and 2-thiazolidine-4-caboxylic acid and 4-acylamino-1,2,4-triazoline-5-thion which is disclosed in Japanese Patent Examined Publication (Kokoku) No. 26777/73 prevent the formation of the colored sludges. It is considered that these mercapto heterocyclic compounds form stable salts with silver halides dissolved in the developing solutions to prevent reduction to colloidal silver. However, these compounds have some unallowable defects, namely, when the processing solutions after used in development is left for several days the colored sludges are formed in a great amount; when the amount of these compounds added is increased to increase the effect of preventing the formation of the colored sludges, the developing speed is extremely decreased; or these compounds have only small effect of preventing the formation of the colored sludges.

SUMMARY OF THE INVENTION

An object of this invention is to provide a liquid processing composition for DTR process which is excellent in stability and prevents formation of colored sludges for a long time without damaging characteristics of silver complex diffusion transfer development.

Another object of this invention is to provide a liquid processing composition for DTR process which improves color tone of transfer silver images, increases transfer density and prevents formation of colored sludges without reducing transfer speed and contrast.

These objects can be attained by containing a specific quaternary ammonium salt in liquid processing composition for DTR process.

DESCRIPTION OF THE INVENTION

It is known to add onium salts such as quaternary ammonium salts to various processing liquids. For examples, U.S. Pat. Nos. 3,173,786 and 3,411,904 disclose the use of quaternary ammonium, quaternary phosphonium and quaternary sulfonium compounds in color diffusion transfer process. Recently this is also proposed in Japanese Patent Unexamined Publications (Kokai) No. 86024/74, No. 114328/77, No. 121321/77, No. 57437/75, No. 42535/76, No. 4542/78, etc.

The quaternary ammonium salts used in this invention are represented by the following general formula (I).

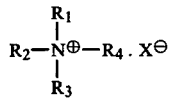

(I)

(wherein $R_1$ to $R_4$ represent alkyl groups of 1–5 carbon atoms, aryl groups or aralkyl groups and X represents an anion, e.g. chloride, bromide, toluene sulfonate, etc. and total number of carbon atoms is 10–22).

The above general formula (I) includes the following general formulas (II)–(IV) as preferred ones.

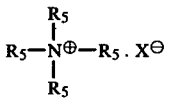

(II)

(wherein $R_5$ represents an alkyl group of 3–5 carbon atoms and X represents an anion).

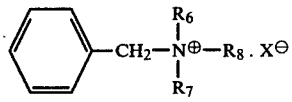

(III)

(wherein $R_6$ to $R_8$ represent alkyl groups of 2–5 carbon atoms and X represents an anion).

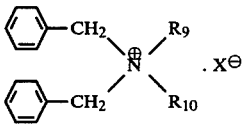

(IV)

(wherein $R_9$ and $R_{10}$ represents alkyl groups of 1–4 carbon atoms and X represents an anion).

The benzyl groups in the general formulas (III) and (IV) can have substituents such as halogen atoms, alkyl groups, alkoxy groups, etc., but as is also clear from the preferred general formulas (II)–(IV), these substituents are preferably selected so that the total number of carbon atoms is 10–22.

When the total carbon number is less than 10, effect of preventing formation of colored sludges is small and when more than 22, at least one of color tone, contrast and transfer density is unsatisfactory. Preferred total carbon number is 12–20. The especially preferred are the compounds represented by the general formula (II).

Quaternary ammonium salts other than those of the general formula (I), for example, pyridinium salts, picolinum salts, etc. as disclosed in U.S. Pat. No. 3,173,786 cannot attain the object of this invention.

Examples of the quaternary ammonium salts used in this invention are as follows:

1. Tetrapropylammonium chloride
2. Tetrapropylammonium bromide
3. Tetrabutylammonium chloride
4. Tetrabutylammonium bromide
5. Tetrapentylammonium bromide
6. Triethylbenzylammonium chloride
7. Tripropylbenzylammonium chloride
8. Tributylbenzylammonium chloride
9. Dimethyldibenzylammonium chloride
10. Dipropyldibenzylammonium chloride
11. Phenyltriethylammonium paratoluene sulfonate The quaternary ammonium salts represented by the general formula (I) used in this invention may be used in an amount of $5\times10^{-4}$ mol to $1\times10^{-2}$ mol, preferably $1\times10^{-3}$ mol to $5\times10^{-3}$ mol per 1 l of DTR processing composition used. When a bromide is used, the amount should be considered as content of bromide ion in the processing composition.

The compounds of the general formula (I) improve transmission density, but they could somewhat deteriorate reflective density depending on amounts, kinds of materials and components of DTR processing composition. Conveniently, some of the quaternary ammonium salts other than those of the general formula (I) can improve reflective density although they deteriorate other photographic characteristics and when they are used in combination with the compounds of the general formula (I) a slight defect which could occur when the compounds of the general formula (I) are used is overcome and the objects of this invention can be more completely attained.

The quaternary ammonium salts which may be used in combination with the compounds of the general formula (I) are preferably represented by the following general formula (V).

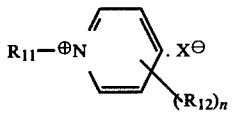

(V)

(wherein $R_{11}$ represents a lower alkyl group, an aryl group or an aralkyl group, $R_{12}$ represents hydrogen atom or a lower alkyl group, n represents 1 or 2 and X represents an anion).

Examples of these compounds are 1-benzylpyridinium chloride, 1-(p-chlorobenzyl)-pyridinium chloride, 1-benzyl-2-picolinium bromide, 1-phenetyl-2-picolinium p-toluensulfonate, 2,4-dimethyl-1-phenetylpyridinium bromide, 2-ethyl-1-phenetylpyridinium bromide, 1-n-heptyl-2-picolinium bromide, N-ethylpyridinium bromide, etc. and U.S. Pat. Nos. 3,173,786 and 3,411,904 may be referred to for other examples.

Amount of these compounds used is preferably 0.2–2.0 mols per 1 mol of the compounds of the general formula (I).

The liquid processing compositions used for DTR process according to this invention contain alkaline materials, e.g., sodium hydroxide, potassium hydroxide, lithium hydroxide and trisodium phosphate, preservatives, e.g., sodium sulfite, thickener, e.g., carboxymethylcellulose and hydoxyethylcellulose, antifoggants, e.g., potassium bromide, silver halide solvents, e.g., sodium thiosulfate, color toning agents, e.g., 1-phenyl-5-mercaptotetrazole, developing modifiers, e.g., polyoxyalkylene compounds, development nuclei, e.g., those mentioned in British Pat. No. 1,001,558 and if necessary, developers, e.g., hydroquinone, 1-phenyl-3-pyrazolidone, etc.

pH of the liquid processing composition is that activating the developers, usually, about 10–14, preferably about 12–14. Optimum pH in specific DTR processes depends on photographic elements, desired images, kinds and amounts of various compounds used in the processing compositions and processing conditions.

Naturally, techniques for improving color tone, density, transfer speed, separability, etc. as mentioned before can also be utilized in this invention.

Preferably, compounds described in Japanese Patent Application No. 1019/79 are additionally used for preventing formation of colored sludges. Furthermore, it is especially preferred for accomplishing the objects of this invention that the liquid processing composition has a cation concentration of 2–12 mol% and it contains a substituted amino alcohol represented by R—NH—$C_2H_4OH$ (R is an alkyl group of $C_1$–$C_4$) as disclosed in Japanese Patent Application No. 153369/78.

Conditions of processing carried out with the processing composition, e.g., time, temperature and the like vary depending on various factors such as components of photographic elements, components of processing compositions, etc. and are not limitative.

In DTR process, developer is usually incorporated in light sensitive silver halide emulsion layer and/or image receiving layer or other water permeable colloid layer adjacent to said layers as disclosed in, e.g., British Pat. Nos. 1,000,115, 1,012,476, 1,093,177, etc. Therefore, the processing composition to be used at developing stage can be the so-called alkaline activating solution.

The processing composition of this invention can preferably be an alkaline activating liquid processing composition.

The liquid processing composition of this invention may contain other additives generally used in DTR processing composition besides the various compounds mentioned hereinbefore.

General negative materials for DTR process comprise a support and at least one silver halide emulsion layer provided thereon and the silver halide is coated generally in an amount of 0.5 g/m$^2$–3.5 g/m$^2$ in terms of silver nitrate. Besides this silver halide emulsion layer, if necessary, there may be provided auxiliary layers such as undercoat layer, intermediate layer, protective layer, peeling layer, etc. For example, a layer of water permeable binders, e.g., methycellulose and sodium salts of carboxymethylcellulose, sodium alginate, etc. may be provided as a covering layer for silver halide emulsion layer of the negative materials used in this invention as disclosed in Japanese Patent Examined Publication (Kokoku) No. 18134/63 and No. 18135/63 to uniformly effect the transfer. Said layer should be thin not so as to substantially prevent or inhibit the transfer. The silver halide emulsion layers in the negative materials and the image receiving layer in the positive materials contain at least one of hydrophilic colloid materials, e.g., gelatin, gelatin derivatives such as phthalated gelatin, cellulose derivatives such as carboxymethyl cellulose, hydroxymethylcellulose and hydrophilic high polymer colloid materials such as dextrin, soluble starch, polyvinyl alcohol, polystyrenesulfonic acid, etc.

The silver halide emulsions comprise silver halides such as silver chloride, silver bromide, silver chlorobromide, silver chloroiodide, silver bromoiodide and silver chlorobromoiodide which are dispersed in said hydrophilic colloid. The silver halide emulsions may be sensitized by various methods at its preparation or coating. For example, they may be chemically sensitized with sodium thiosulfate, alkylthiourea or gold compounds such as gold rhordanide, gold chloride or combinations of such compounds. The emulsions are ordinarily further spectro-sensitized for wavelengths of about 530 nm–about 560 nm, but may also be panchromatically spectro-sensitized.

The silver halide emulsion layers and/or the image receiving layers may contain optional compounds commonly used for carrying out silver complex diffusion transfer processes. These compounds include antifoggants such as tetrazainedene, mercaptotetrazoles, etc., coating aids such as saponin, polyalkylene oxides, etc., hardeners such as formalin, chrome alum, etc., plasticizers, etc. The supports used for negative materials or image receiving materials may be any of conventional supports which include paper, glass, films such as cellulose acetate film, polyvinyl acetal film, polystyrene film, polyethylene terephthalate film, etc., metallic supports both sides of which are coated with papers and paper supports and paper supports one or both sides of which are coated with $\alpha$-olefin polymers such as polyethylene. The image receiving materials may contain physical development nuclei, e.g., heavy metals or sulfides thereof. At least one layers of the image receiving layers may contain substances which play a great part for forming diffusion transfer images such as black toning agents disclosed in British Pat. No. 561,875 and Belgian Pat. No. 502525, for example, 1-phenyl-5-mercaptotetrazole. The image receiving materials may further contain a fixing agent such as sodium thiosulfate in an amount of about 0.1–about 4 g/m$^2$.

Developing substances may be also contained in image receiving materials as disclosed in Japanese Patent Examined Publication (Kokoku) No. 27568/64.

The following non-limiting examples are included for a further understanding of this invention.

EXAMPLE 1

Positive materials were produced by providing on one surface of a paper support of 110 g/m$^2$ both surfaces of which had been coated with polyethylene an image receiving layer of a processed product of PVA and an ethylene-maleic anhydride copolymer containing palladium sulfide nuclei in a dry weight of 3 g/m$^2$.

On the other hand, negative materials were produced by providing an undercoat layer containing carbon black for antihalation on the same paper support as used for producing the positive materials and further providing thereon an orthochromatically spectrosensitized gelatin silver halide emulsion layer containing silver chlorobromide (silver bromide 10 mol%) having an average particle diameter of 0.3$\mu$ in an amount of 1.5 g/m$^2$ in terms of silver nitrate and additionally containing 0.2 g/m$^2$ of 1-phenyl-4-methyl-pyrazolidone and 0.7 g/m$^2$ of hydroquinone, etc.

The emulsion surface of the negative material which was sensitometrically exposed and the image receiving surface of the positive material were brought into contact with each other. The resulting so-called sandwich was passed through a conventional developing processor containing a developing solution for silver complex diffusion transfer processes having the following composition and after withdrawn from squeezing rollers, the sandwich was peeled apart in 30 seconds.

| | |
|---|---|
| Water | 700 ml |
| Trisodium phosphate (12 hydrate) | 75 g |
| Anhydrous sodium sulfite | 40 g |
| Potassium hydroxide | 10 g |
| Sodium thiosulfate (5 hydrate) | 20 g |
| Potassium bromide | 1.0 g |
| 1-phenyl-5-mercaptotetrazole | 70 mg |
| Methylaminoethanolamine | 20 ml |
| Water to make 1 l | |

Separately, each of quaternary ammonium salts (2), (4), (5), (7) and (9) as exemplified hereinbefore and the following quaternary ammonium salts for comparison was added to the above developing solution in an amount of $3\times10^{-3}$ mol. The same procedure as mentioned above was repeated with these developing solutions containing the quaternary ammonium salts.

Comparative compound A $N^{\oplus}(C_2H_5)_4 . Cl^{\ominus}$

Comparative compound B $C_{12}H_{25}-N^{\oplus}(CH_3)_3 . Cl^{\ominus}$

Comparative compound C

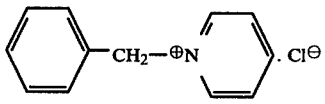

Comparative compound D

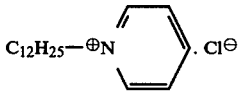

Comparative compound E

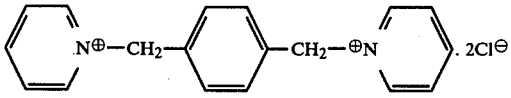

Evaluation of the results was conducted by the following rating for simplification. That is, after preparation of each liquid processing composition, fifty negative and positive materials of A4 size were processed as mentioned above and photographic characteristics of thus obtained prints in comparison with those obtained using the blank processing composition were expressed by the following ratings.

| Ratings | Items: Color tone of silver image | Contrast | Reflective density |
|---|---|---|---|
| ⊙ | Purer black | Harder tone | Higher |
| o | No difference | No difference | No difference |
| Δ | Discoloration to slightly red or brown | Slightly softer | Slightly lower |
| x | Much discoloration to red or brown | Extremely softer | Extremely lower |

Formation of colored sludge in each liquid processing composition after lapse of one hour and one week from processing was evaluated by the following rating.

O: No colored sludge was formed.

Δ: Some colored sludge was formed.

X: much colored sludge was formed.

The results are shown in Table 1.

TABLE 1

| No. | Compounds | Colored sludge: After 1 hour | Colored sludge: After 1 week | Color tone | Contrast | Density |
|---|---|---|---|---|---|---|
| 1 | None | x | x | Somewhat reddish | — | — |
| 2 | Comparative A | o | Δ | o | o | o |
| 3 | Comparative B | Δ | x | x | Δ | x |
| 4 | Comparative C | o | Δ | x | x | ⊙ |
| 5 | Comparative D | Δ | x | x | x | x |
| 6 | Comparative E | o | Δ | x | Δ | x |
| 7 | Exemplified No. (2) | o | o | ⊙ | o | o |
| 8 | Exemplified No. (4) | o | o | ⊙ | o | o |
| 9 | Exemplified No. (5) | o | o | ⊙ | o | o |
| 10 | Exemplified No. (7) | o | o | o | o | o |
| 11 | Exemplified No. (9) | o | o | o | o | o |

It will be recognized that the processing compositions of this invention inhibit formation of colored sludge, improve color tone or give no adverse effect on color tone and result in no adverse effects on contrast and density.

EXAMPLE 2

Example 1 was repeated except that the liquid processing composition having the following basic composition was used.

| | |
|---|---|
| Trisodium phosphate (12 hydrate) | 82 g |
| Anhydrous sodium sulfite | 35 g |
| Potassium bromide | 1 g |
| Anhydrous sodium thiosulfate | 7 g |
| 1-phenyl-5-mercaptotetrazole | 50 mg |
| Ethylenediaminetetraacetic acid | 1 g |
| Sorbitol | 25 g |
| Polyoxyethylenesorbitan monolaurate | 1 g |
| Methylaminoethanolamine | 20 ml |
| Surfynol 465* | 1 g |
| Water to make 1 l | |

*Trade name of Air Product and Chemicals Inc. for acetylene glycol series compounds, amount of which is shown in terms of acetylene glycol.

Results obtained using the above liquid processing compositions to which quaternary ammonium salts as shown in Table 2 were added in a total amount of $5\times10^{-3}$ mol are also shown in Table 2. The test on colored sludge after 1 week means that the composition was force-left at 50° C. for 1 week.

TABLE 2

| No. | Compounds (molar ratio) | Colored sludge After 1 hour | Colored sludge After 1 week at 50° C. | Color tone | Contrast | Reflective density |
|---|---|---|---|---|---|---|
| 12 | None | o | x | Somewhat brownish | — | — |
| 13 | No. 4 | o | o | ⊙ | o | Δ |
| 14 | No. 7 | o | Δ | o | o | Δ |
| 15 | No. 4 + Comparative C (1 : 1) | o | o | ⊙ | o | ⊙ |
| 16 | No. 4 + Comparative F (1 : 1) | o | o | ⊙ | o | ⊙ |
| 17 | No. 4 + Comparative G (1 : 1) | o | o | ⊙ | o | o |
| 18 | No. 7 + Comparative C (1 : 1) | o | Δ | o | o | ⊙ |
| 19 | No. 7 + Comparative F (1 : 1) | o | Δ | o | o | ⊙ |
| 20 | No. 7 + Comparative G (1 : 1) | o | Δ | o | o | o |

Comparative compound F is 1-benzyl-2-picolinium bromide and G is N-ethyl-pyridinium bromide.

As shown in Table 2, in No. 13 and No. 14 the reflective density slightly decreased, but when comparative compounds C, F and G were additionally used good results were obtained.

EXAMPLE 3

Example 2 was repeated except that a polyester film transparent support was used as the support of positive materials. It was recognized that transmission density increased in the cases of processing compositions No. 13–20 as compared with the processing composition No. 12. Other results were the same as in Example 2.

What is claimed is:

1. A process of forming a transfer image by silver complex diffusion transfer processes which includes the step of effecting development and transfer in the presence of a liquid processing composition which comprises:
   (1) an alkaline material,
   (2) an alkali metal sulfite,
   (3) a silver halide solvent for forming a soluble silver complex salt which diffuses to an image receiving layer having physical development nuclei, and
   (4) a compound represented by the following general formula (I):

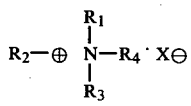

(I)

wherein $R_1$–$R_4$ represent alkyl groups of 1–5 carbon atoms, aryl groups or aralkyl groups, X represents an anion and the total number of carbon atoms is 10–22.

2. A process according to claim 1, wherein the compound of the general formula (I) is a compound represented by the following general formula (II):

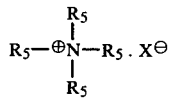

(II)

wherein $R_5$ represents an alkyl group of 3–5 carbon atoms and X represents an anion.

3. A process according to claim 1 or 2 which contains the compound of the general formula (I) in an amount of $5\times10^{-4}$ mol–$1\times10^{-2}$ mol per 1 l.

4. A process according to claim 1, wherein the total number of carbon atoms of the compound represented by the general formula (I) is 12–20.

5. A process according to claim 1, wherein the compound of the general formula (I) is a compound represented by the following general formula (II):

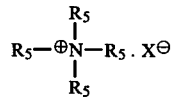

(II)

wherein $R_5$ represents an alkyl group of 3–5 carbon atoms and X represents an anion.

6. A process according to claim 1, wherein the composition additionally contains a compound represented by the following general formula (V) in an amount of 0.2–2.0 mols per 1 mol of the compound of general formula (I):

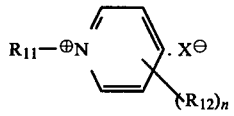

(V)

wherein $R_{11}$ represents a lower alkyl group, an aryl group or an aralkyl group, $R_{12}$ represents hydrogen atom or a lower alkyl group and n is 1 or 2.

7. A process according to claim 1, wherein the composition contains the compound of general formula (I) in an amount of $5\times10^{-4}$ mol $1\times10^{-2}$ mol per 1 l.

8. A silver complex diffusion transfer processing composition which comprises:
   (1) an alkaline material,
   (2) an alkali metal sulfite,
   (3) a silver halide solvent for forming a soluble silver complex salt which diffuses to an image receiving layer having physical development nuclei,
   (4) a compound represented by the following general formula (I):

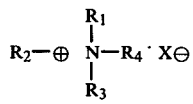

(I)

wherein $R_1$–$R_4$ represent alkyl groups of 1–5 carbon atoms, aryl groups or aralkyl groups, X represents an anion and the total number of carbon atoms is 10–22, and a compound represented by the following general formula (V) in an amount of 0.2–2.0 mols per 1 mol of the compound of general formula (I):

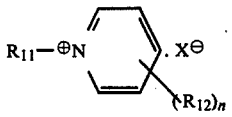

(V)

wherein $R_{11}$ represents a lower alkyl group, an aryl group or an aralkyl group, $R_{12}$ represents hydrogen atom or a lower alkyl group and n is 1 or 2.

9. A liquid processing composition according to claim 8 containing the compound of general formula (I) in an amount of $5\times10^{-4}$ mol to $1\times10^{-2}$ mol per liter.

10. A silver complex diffusion transfer processing composition which comprises:

(1) an alkaline material, (2) an alkali metal sulfite, (3) a silver halide solvent for forming a soluble silver complex salt which diffuses to an image receiving layer having physical development nuclei, (4) a compound represented by the following general formula (II):

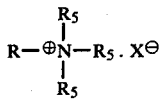

(II)

wherein $R_5$ represents an alkyl groups of 3–5 carbon atoms, and X represents an anion, and (5) a toning agent.

11. A silver complex diffusion transfer processing composition which comprises:

(1) an alkaline material, (2) an alkali metal sulfite, (3) a silver halide solvent for forming a soluble silver complex salt which diffuses to an image receiving layer having physical development nuclei, (4) a compound represented by the following general formula (I):

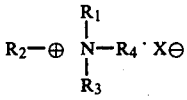

(I)

wherein $R_1$–$R_4$ represent alkyl groups of 1–5 carbon atoms, aryl groups or aralkyl groups, X represents an anion and the total number of carbon atoms is 10–22, and (5) a toning agent.

12. A silver complex diffusion transfer processing composition according to claim 11, wherein the total number of carbon atoms of the compound represented by the general formula (I) is 12–20.

* * * * *